US008208642B2

(12) United States Patent
Edwards

(10) Patent No.: US 8,208,642 B2
(45) Date of Patent: Jun. 26, 2012

(54) METHOD AND APPARATUS FOR A BINAURAL HEARING ASSISTANCE SYSTEM USING MONAURAL AUDIO SIGNALS

(75) Inventor: Brent Edwards, San Francisco, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1309 days.

(21) Appl. No.: 11/456,538

(22) Filed: Jul. 10, 2006

(65) Prior Publication Data

US 2008/0008341 A1 Jan. 10, 2008

(51) Int. Cl.
*H04R 5/00* (2006.01)
*H04R 25/00* (2006.01)

(52) U.S. Cl. ..... 381/23.1; 381/17; 381/309; 381/97; 381/77; 381/80; 381/81; 381/311; 381/315; 381/312; 381/74; 381/370; 455/41.2; 455/41.3; 455/414.1

(58) Field of Classification Search ..... 381/315, 381/60, 172, 312, 23.1, 314, 316, 74, 327, 381/370, 17, 309, 97, 77, 80, 81, 311; 455/41.2, 455/41.3, 414.1
See application file for complete search history.

(56) References Cited

U.S. PATENT DOCUMENTS

| | | | | |
|---|---|---|---|---|
| 3,527,901 | A | | 9/1970 | Geib |
| 3,571,514 | A | | 3/1971 | Wruk |
| 3,770,911 | A | | 11/1973 | Knowles et al. |
| 3,798,390 | A | | 3/1974 | Gage et al. |
| 3,836,732 | A | | 9/1974 | Johanson et al. |
| 3,875,349 | A | | 4/1975 | Ruegg |
| 3,894,196 | A | * | 7/1975 | Briskey ..... 381/23.1 |
| 3,946,168 | A | | 3/1976 | Preves |
| 3,975,599 | A | | 8/1976 | Johanson |
| 4,051,330 | A | | 9/1977 | Cole |
| 4,142,072 | A | | 2/1979 | Berland |
| 4,366,349 | A | | 12/1982 | Adelman |
| 4,396,806 | A | | 8/1983 | Anderson |
| 4,419,544 | A | | 12/1983 | Adelman |
| 4,449,018 | A | | 5/1984 | Stanton |

(Continued)

FOREIGN PATENT DOCUMENTS

CH 673551 3/1990

(Continued)

OTHER PUBLICATIONS

Haartsen, J., "Bluetooth—The Universal Radio Interface for Ad Hoc, Wireless Connectivity", *Ericsson Review*, No. 3,(1998), 110-117.

(Continued)

*Primary Examiner* — Vivian Chin
*Assistant Examiner* — Paul Kim
(74) *Attorney, Agent, or Firm* — Schwegman, Lundberg & Woessner, P.A.

(57) ABSTRACT

The present application provides method and apparatus for a binaural hearing assistance system using a monaural audio signal input. The system, in various examples, provides adjustable delay/phase adjustment and sound level adjustment. Different embodiments are provided for receiving the monaural signal and distributing it to a plurality of hearing assistance devices. Different relaying modes are provided. Special functions are supported, such as telecoil functions. The system also has examples that account for a head-related transfer function in providing advanced sound processing for the wearer. Other examples are provided that are described in the detailed description.

45 Claims, 6 Drawing Sheets

U.S. PATENT DOCUMENTS

| | | | | |
|---|---|---|---|---|
| 4,456,795 | A | 6/1984 | Saito | |
| 4,471,490 | A | 9/1984 | Bellafiore | |
| 4,622,440 | A | 11/1986 | Slavin | |
| 4,637,402 | A | 1/1987 | Adelman | |
| 4,712,244 | A | 12/1987 | Zwicker et al. | |
| 4,723,293 | A | 2/1988 | Harless | |
| 4,751,738 | A | 6/1988 | Widrow et al. | |
| 4,882,762 | A | 11/1989 | Waldhauer | |
| 5,029,215 | A | 7/1991 | Miller, II | |
| 5,214,709 | A | 5/1993 | Ribic | |
| 5,226,087 | A | 7/1993 | Ono et al. | |
| 5,289,544 | A | 2/1994 | Franklin | |
| 5,390,254 | A | 2/1995 | Adelman | |
| 5,434,924 | A * | 7/1995 | Jampolsky | 381/23.1 |
| 5,479,522 | A | 12/1995 | Lindemann et al. | |
| 5,483,599 | A | 1/1996 | Zagorski | |
| 5,502,769 | A | 3/1996 | Gilbertson | |
| 5,524,056 | A | 6/1996 | Killion et al. | |
| 5,553,152 | A | 9/1996 | Newton | |
| 5,581,747 | A | 12/1996 | Anderson | |
| 5,651,071 | A | 7/1997 | Lindemann et al. | |
| 5,659,621 | A | 8/1997 | Newton | |
| 5,721,783 | A | 2/1998 | Anderson | |
| 5,734,976 | A | 3/1998 | Bartschi et al. | |
| 5,757,932 | A | 5/1998 | Lindemann et al. | |
| 5,757,933 | A | 5/1998 | Preves et al. | |
| 5,822,442 | A | 10/1998 | Agnew et al. | |
| 5,825,631 | A | 10/1998 | Prchal | |
| 5,835,611 | A | 11/1998 | Kaiser et al. | |
| 5,852,668 | A | 12/1998 | Ishige et al. | |
| 5,862,238 | A | 1/1999 | Agnew et al. | |
| 5,991,419 | A | 11/1999 | Brander | |
| 6,041,129 | A | 3/2000 | Adelman | |
| 6,078,825 | A | 6/2000 | Hahn et al. | |
| 6,144,748 | A | 11/2000 | Kerns | |
| 6,157,728 | A | 12/2000 | Tong et al. | |
| 6,236,731 | B1 | 5/2001 | Brennan et al. | |
| 6,240,192 | B1 | 5/2001 | Brennan et al. | |
| 6,311,155 | B1 * | 10/2001 | Vaudrey et al. | 704/225 |
| 6,347,148 | B1 | 2/2002 | Brennan et al. | |
| 6,366,863 | B1 | 4/2002 | Bye et al. | |
| 6,381,308 | B1 | 4/2002 | Cargo et al. | |
| 6,389,142 | B1 | 5/2002 | Hagen et al. | |
| 6,449,662 | B1 | 9/2002 | Armitage | |
| 6,549,633 | B1 | 4/2003 | Westermann | |
| 6,633,645 | B2 | 10/2003 | Bren et al. | |
| 6,760,457 | B1 | 7/2004 | Bren et al. | |
| 7,103,191 | B1 | 9/2006 | Killion | |
| 7,116,792 | B1 | 10/2006 | Taenzer et al. | |
| 7,139,404 | B2 | 11/2006 | Feeley et al. | |
| 7,369,669 | B2 | 5/2008 | Hagen et al. | |
| 7,561,707 | B2 | 7/2009 | Kornagel | |
| 7,590,253 | B2 | 9/2009 | Killion | |
| 7,822,217 | B2 | 10/2010 | Hagen et al. | |
| 8,041,066 | B2 | 10/2011 | Solum | |
| 2001/0007050 | A1 | 7/2001 | Adelman | |
| 2002/0006206 | A1 | 1/2002 | Scofield | |
| 2002/0076073 | A1 | 6/2002 | Taenzer et al. | |
| 2002/0090099 | A1 | 7/2002 | Hwang | |
| 2002/0131614 | A1 | 9/2002 | Jakob et al. | |
| 2002/0186857 | A1 | 12/2002 | Bren et al. | |
| 2003/0045283 | A1 | 3/2003 | Hagedoorn | |
| 2003/0059073 | A1 | 3/2003 | Bren et al. | |
| 2003/0133582 | A1 | 7/2003 | Niederdrank | |
| 2003/0215106 | A1 | 11/2003 | Hagen et al. | |
| 2004/0010181 | A1 | 1/2004 | Feeley et al. | |
| 2004/0052391 | A1 | 3/2004 | Bren et al. | |
| 2004/0077387 | A1 | 4/2004 | Sayag et al. | |
| 2005/0160270 | A1 | 7/2005 | Golberg et al. | |
| 2006/0018497 | A1 * | 1/2006 | Kornagel | 381/315 |
| 2006/0039577 | A1 | 2/2006 | Sanguino et al. | |
| 2006/0068842 | A1 | 3/2006 | Sanguino et al. | |
| 2006/0093172 | A1 | 5/2006 | Ludvigsen et al. | |
| 2006/0193273 | A1 | 8/2006 | Passier et al. | |
| 2006/0198529 | A1 * | 9/2006 | Kjems et al. | 381/26 |
| 2006/0205349 | A1 | 9/2006 | Passier et al. | |
| 2006/0274747 | A1 | 12/2006 | Duchscher et al. | |
| 2007/0149261 | A1 | 6/2007 | Huddart | |
| 2008/0159548 | A1 | 7/2008 | Solum | |
| 2008/0273727 | A1 | 11/2008 | Hagen et al. | |
| 2008/0306745 | A1 | 12/2008 | Roy et al. | |
| 2011/0158442 | A1 | 6/2011 | Woods | |

FOREIGN PATENT DOCUMENTS

| | | | |
|---|---|---|---|
| EP | 0789474 | A2 | 8/1997 |
| EP | 1185138 | | 3/2002 |
| EP | 1174003 | B1 | 7/2004 |
| EP | 1519625 | A2 | 3/2005 |
| EP | 1531650 | A2 | 5/2005 |
| EP | 1531650 | A2 * | 5/2005 |
| EP | 1670283 | A1 | 6/2006 |
| EP | 1715718 | A2 | 10/2006 |
| EP | 1365628 | B1 | 12/2011 |
| WO | WO-96/41498 | A1 | 12/1996 |
| WO | WO-0021332 | A2 | 4/2000 |
| WO | WO-0158064 | A1 | 8/2001 |
| WO | WO-01/67433 | A1 | 9/2001 |
| WO | WO-02/09363 | A2 | 1/2002 |
| WO | WO-0203750 | A2 | 1/2002 |
| WO | WO-0223950 | A2 | 3/2002 |
| WO | WO-2004034738 | A1 | 4/2004 |
| WO | WO 2004034738 | A1 * | 4/2004 |
| WO | WO-2004/100607 | A1 | 11/2004 |
| WO | WO-2004110099 | A2 | 12/2004 |
| WO | WO-2005/101731 | A2 | 10/2005 |
| WO | WO-2006/023857 | A1 | 3/2006 |
| WO | WO-2006/023920 | A1 | 3/2006 |
| WO | WO-2006/133158 | A1 | 12/2006 |

OTHER PUBLICATIONS

Preves, D. A., "A Look at the Telecoil—It's Development and Potential", *SHHH Journal*, (Sep./Oct. 1994), 7-10.

"European Application Serial No. 07252582.7, Extended European Search Report mailed Apr. 4, 2008", 7 pgs.

"Kleer Announces Reference Design for Wireless Earphones", [Online]. Retrieved from the Internet: <URL:http://kleer.com/newsevents/press_releases/prjan2.php>, (Jan. 2, 2007), 2 pgs.

"U.S. Appl. No. 09/052,631, Final Office Action mailed Jul. 11, 2000", 8 pgs.

"U.S. Appl. No. 09/052,631, Final Office Action mailed Jul. 30, 2001", 5 pgs.

"U.S. Appl. No. 09/052,631, Non Final Office Action mailed Jan. 18, 2001", 6 pgs.

"U.S. Appl. No. 09/052,631, Non Final Office Action mailed Dec. 28, 1999", 10 pgs.

"U.S. Appl. No. 09/052,631, Notice of Allowance mailed Dec. 18, 2001", 6 pgs.

"U.S. Appl. No. 09/052,631, Response filed May 18, 2001 to Non Final Office Action mailed Jan. 18, 2001", 7 pgs.

"U.S. Appl. No. 09/052,631, Response filed Oct. 30, 2001 to Final Office Action mailed Jul. 30, 2001", 5 pgs.

"U.S. Appl. No. 09/052,631, Response filed Nov. 10, 2000 to Final Office Action mailed Jul. 11, 2000", 5 pgs.

"U.S. Appl. No. 10/146,536, Advisory Action mailed Oct. 16, 2007", 5 pgs.

"U.S. Appl. No. 10/146,536, Final Office Action mailed May 18, 2007", 28 pgs.

"U.S. Appl. No. 10/146,536, Non-Final Office Action mailed Sep. 19, 2006", 26 pgs.

"U.S. Appl. No. 10/146,536, Non-Final Office Action mailed Dec. 16, 2005", 25 pgs.

"U.S. Appl. No. 10/146,536, Notice of Allowance mailed Dec. 27, 2007", 10 pgs.

"U.S. Appl. No. 10/146,536, Response filed Feb. 20, 2007 to Non-Final Office Action mailed Sep. 19, 2006", 20 pgs.

"U.S. Appl. No. 10/146,536, Response filed Jun. 16, 2006 to Non-Final Office Action mailed Dec. 16, 2005", 14 pgs.

"U.S. Appl. No. 10/146,536, Response filed Nov. 19, 2007 to Final Office Action mailed May 18, 2007", 19 pgs.

"U.S. Appl. No. 10/146,536, Response filed Sep. 18, 2007 to Final Office Action dated Jun. 18, 2007", 24 pgs.

"U.S. Appl. No. 11/619,541, Non Final Office Action mailed Dec. 21, 2010", 7 pgs.
"U.S. Appl. No. 12/115,423, Notice of Allowance mailed Sep. 15, 2010", 9 pgs.
"Canadian Application No. 2,428,908, Office Action mailed Mar. 15, 2007", 6 pgs.
"Canadian Application No. 2,428,908, Office Action mailed Nov. 4, 2008", 9 pgs.
"European Application Serial No. 03253052, European Search Report mailed Nov. 24, 2005", 2 pgs.
"European Application Serial No. 03253052.9, Office Action mailed Mar. 26, 2009", 3 pgs.
"European Application Serial No. 03253052.9, Response filed Dec. 7, 2010 to Office Action mailed Mar. 26, 2009", 19 pgs.
"European Application Serial No. 07252582.7, Office Action Mailed Feb. 6, 2009", 2 pgs.
"European Application Serial No. 07252582.7, Response filed Aug. 11, 2009 to Office Communication mailed Feb. 6, 2009", 2 pgs.
"European Application Serial No. 07252582.7.0, Office Action mailed Oct. 15, 2010", 4 pgs.
"European Application Serial No. 07254947.0, Extended European Search Report mailed Apr. 3, 2008", 6 pgs.
"European Application Serial No. 07254947.0, Office Action mailed Oct. 12, 2010", 4 pgs.
"European Application Serial No. 07254947.0, Response filed Feb. 28, 2009 to Official Communication mailed Aug. 25, 2008", 2 pgs.
"Technical Data Sheet—Microphone Unit 6903", Published by Microtronic, (Dec. 2000), 2 pgs.
Davis, A., et al., "Magnitude of Diotic Summation in Speech-in-Noise Tasks:Performance Region and Appropriate Baseline", British Journal of Audiology, 24, (1990), 11-16.
Greefkes, J. A, et al., "Code Modulation with Digitally Controlled Companding for Speech Transmission", Philips Tech. Rev., 31(11/12), (1970), 335-353.
Griffing, Terry S, et al., "Acoustical Efficiency of Canal ITE Aids", Audecibel, (Spring 1983), 30-31.
Griffing, Terry S, et al., "Custom canal and mini in-the-ear hearing aids", Hearing Instruments, vol. 34, No. 2, (Feb. 1983), 31-32.
Griffing, Terry S, et al., "How to evaluate, sell, fit and modify canal aids", Hearing Instruments, vol. 35, No. 2, (Feb. 1984), 3.
Halverson, H. M., "Diotic Tonal Volumes as a Function of Difference of Phase", The American Journal of Psychology, 33(4), (Oct. 1922), 526-534.
Lindemann, Eric, "Two Microphone Nonlinear Frequency Domain Beamformer for Hearing Aid Noise Reduction", Proc. IEEE Workshop on Applications of Signal Processing to Audio and Acoustics, (1995), 24-27.
Mahon, William J, "Hearing Aids Get a Presidential Endorsement", The Hearing Journal,, (Oct. 1983), 7-8.
Peissig, J., et al., "Directivity of binaural noise reduction in spatial multiple noise-source arrangements for normal and impaired listeners", J Acoust Soc Am., 101(3), (Mar. 1997), 1660-70.
Preves, David A., "Field Trial Evaluations of a Switched Directional/Omnidirectional In-the-Ear Hearing Instrument", Journal of the American Academy of Audiology, 10(5), (May 1999), 273-283.
Srinivasan, S., "Low-bandwidth binaural beamforming", IEEE Electronics Letters, 44(22), (Oct. 23, 2008), 1292-1293.
Srinivasan, Sriram, et al., "Beamforming under Quantization Errors in Wireless Binaural Hearing Aids", EURASIP Journal on Audio, Speech, and Music Processing, vol. 2008, Article ID 824797, (Jan. 28, 2008), 8 pgs.
Sullivan, Roy F, "Custom canal and concha hearing instruments: A real ear comparison Part I", Hearing Instruments, vol. 40, No. 4, (Jul. 1989), 23-29.
Sullivan, Roy F, "Custom canal and concha hearing instruments: A real ear comparison Part II", Hearing Instruments, vol. 40, No. 7, (Jul. 1989), 30-36.
Teder, Harry, "Something New in CROS", Hearing Instruments, vol. 27, No. 9, Published by Harcourt Brace Jovanovich, (Sep. 1976), pp. 18-19.
Zelnick, E., "The Importance of Interaural Auditory Differences in Binaural Hearing", In: Binaural Hearing and Amplification, vol. 1, Libby, E. R., Editor, Zenetron, Inc., Chicago, IL, (1980), 81-103.
"U.S. Appl. No. 11/619,541, Notice of Allowance mailed Jul. 5, 2011", 6 pgs.
"U.S. Appl. No. 11/619,541, Response filed May 23, 2011 to Non Final Office Action mailed Dec. 21, 2010", 10 pgs.
"Canadian Application Serial No. 2,428,908, Response filed Sep. 17, 2007 to Office Action mailed Mar. 15, 2007", 25 pgs.
"European Application Serial No. 03253052.9, Response filed Oct. 5, 2009 to Office Action filed Mar. 26, 2009", 25 pgs.
"European Application Serial No. 07252582.7, Response to Office Action filed Apr. 20, 2011", 4 pgs.
"European Application Serial No. 07254947.0, Office Action mailed Aug. 25, 2008", 1 pgs.
"European Application Serial No. 07254947.0, Response filed Apr. 26, 2011 to Official Communication mailed Oct. 12, 2010", 11 pgs.
"European Application Serial No. 03253052.9, Notice of Decision to Grant mailed Nov. 17, 2011", 1 pg.
"European Application Serial No. 07252582.7, Office Action mailed Dec. 27, 2011", 4 pgs.
"European Application Serial No. 07254947.0, Office Action mailed Jan. 19, 2012", 5 pgs.
"European Applicatino Serial No. 07252582.7, Response filed Apr. 27, 2012 to Office Action mailed Dec. 27, 2011", 3 pgs.

* cited by examiner

METHOD AND APPARATUS FOR A BINAURAL HEARING ASSISTANCE SYSTEM USING MONAURAL AUDIO SIGNALS

FIELD OF THE INVENTION

This application relates generally to method and apparatus for a hearing assistance system, and more particularly to method and apparatus for a binaural hearing assistance system using a monaural audio signal.

BACKGROUND

Modern wireless audio devices frequently apply a monaural signal to a single ear. For example, devices such as cell phones and cellular headsets receive monaural communications for application to a single ear. By this approach, many advantages of binaural hearing are lost. Such devices only apply sound to one ear, so hearing can be impaired by loud noises in the other ear, and hearing can be impaired by hearing limitations associated with a particular ear.

Thus, there is a need in the art for an improved hearing assistance system which provides the advantages of binaural hearing for listening to a monaural signal. The system should be controllable to provide better hearing, convenience, and an unobtrusive design. In certain variations, the system may also allow a user to customize his or her hearing experience by controlling the sounds received by the system.

SUMMARY

This application addresses the foregoing need in the art and other needs not discussed herein. The various embodiments described herein relate to a wireless system for binaural hearing assistance devices.

One embodiment includes an apparatus for a user having a first ear and a second ear, including a wireless device to transmit a signal containing monaural information; a first hearing assistance device including: a first radio receiver to receive the signal; an adjustable phase shifter adapted to apply a plurality of controllable, incremental phase shifts to the monaural information on the signal; and a first speaker to produce a first audio signal for the first ear; and a second hearing assistance device including a second radio receiver and a second speaker to produce a second audio signal for the second ear, wherein the first and second audio signals are produced with adjustable relative phase based on a setting of the adjustable phase shifter. Various embodiments provide adjustable level controls and microphones in combinations of first and/or second hearing assistance devices. Some applications include communications between cellular devices, such as cellular phones and hearing aids. Various embodiments provide applications using wireless audio controllers having packetized audio. Both manual and automatic adjustments are provided. In various embodiments, different combinations of receivers and sensors, such as magnetic field sensors, are provided. In various embodiments, processing adapted to account for head-related transfer functions and for controlling the electronics using it are provided.

In one embodiment, a system is provided for a user having a first ear and a second ear, including: a device comprising a controllable phase shifter adapted to receive a monaural information signal and convert it into a first monaural signal and a second monaural signal, the first and second monaural signals having an interaural phase shift; a first hearing assistance device including: a first receiver adapted to receive the first monaural signal; and a first speaker to produce a first audio signal for the first ear; and a second hearing assistance device including: a second receiver adapted to receive the second monaural signal; and a second speaker to produce a second audio signal for the second ear. Various embodiments provide adjustable level controls and microphones in combinations of first and/or second hearing assistance devices. Some applications include communications between cellular devices, such as cellular phones and hearing aids. Various embodiments provide applications using wireless audio controllers having packetized audio. Both manual and automatic adjustments are provided. In various embodiments, different combinations of receivers and sensors, such as magnetic field sensors, are provided. In various embodiments, processing adapted to account for head-related transfer functions and for controlling the electronics using it are provided.

Methods are also provided, including for example, a method for providing sound to a first ear and a second ear of a wearer of first and second hearing assistance devices, including: receiving a monaural information signal; converting the monaural information signal into a first monaural signal and a second monaural signal, the first and second monaural signals differing in relative phase which is controllable; and providing a first sound based on the first monaural signal to the first ear of the wearer and a second sound based on the second monaural signal to the second ear of the wearer to provide binaural sound to the wearer. Different applications, including different methods for laterializing perceived sounds and levels of perceived sounds, are provided. Different embodiments for methods of use, including sensing telephone (telecoil) modes, are provided. Different embodiments for applications employing head-related transfer functions and relaying are also provided. A variety of different interaural delays and phase changes are provided. Other embodiments not expressly mentioned in this Summary are found in the detailed description.

This Summary is an overview of some of the teachings of the present application and not intended to be an exclusive or exhaustive treatment of the present subject matter. Further details about the present subject matter are found in the detailed description and appended claims.

BRIEF DESCRIPTION OF THE DRAWINGS

Various embodiments are illustrated by way of example in the figures of the accompanying drawings.

DETAILED DESCRIPTION

In the following description, for purposes of explanation, numerous specific details are set forth in order to provide a thorough understanding of the various embodiments. It will be apparent, however, to one skilled in the art that the various embodiments may be practiced without some of these specific details. The following description and drawings provide examples for illustration, and are not intended to provide an exhaustive treatment of all possible implementations.

It should be noted that references to "an", "one", or "various" embodiments in this disclosure are not necessarily to the same embodiment, and such references contemplate more than one embodiment.

The present subject matter presents sound to both ears of a user wearing wireless hearing assistance devices which is derived from a single monaural signal. Among other things, it allows for better control of the received sound and obtains benefits of binaural hearing for listening to the monaural signal. In various embodiments, the sound presented to one ear is phase shifted relative to the sound presented to the other ear. In various embodiments, the phase shift arises from a constant time delay. In various embodiments, the phase shift arises from a constant phase shift at all frequencies. In various embodiments, the phase shift arises from a phase shift that is varying as a function of frequency. In various embodiments, the sound presented to one ear is set to a different level relative to the sound presented to the other ear. In various embodiments, the sound presented to one ear is controllable in relative phase and in relative level with respect to the sound presented to the other ear. Various apparatus and method set forth herein can be employed to accomplish these embodiments and their equivalents. Other variations not expressly set forth herein exist which are within the scope of the present subject matter. Thus, the examples provided herein demonstrate various aspects of the present subject matter and are not intended to be limiting or exclusive.

Figure 1A:
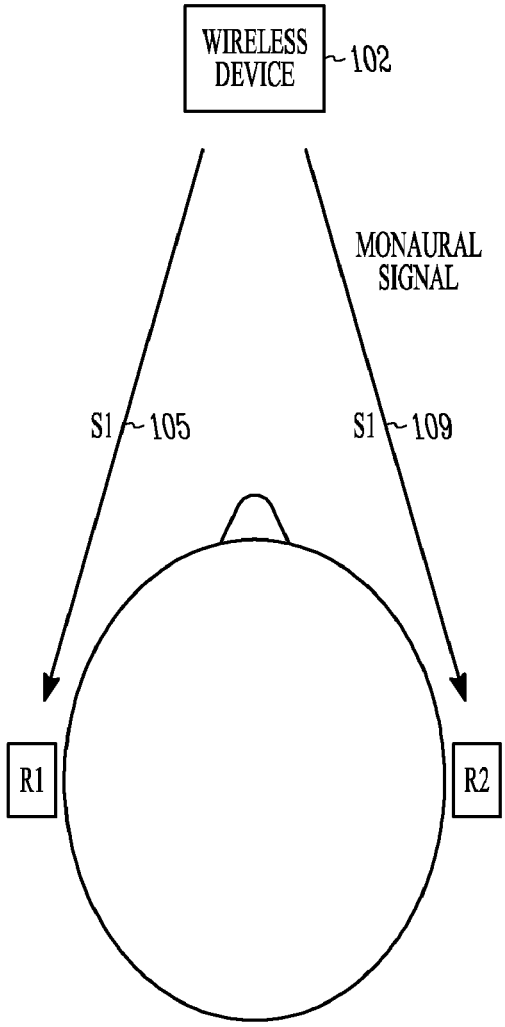
FIG. 1A shows one system using devices in a direct communication mode according to one embodiment of the present subject matter.

FIG. 1A shows one system using devices in a direct communication mode according to one embodiment of the present subject matter. In various embodiments, wireless device 102 supports one or more communication protocols. In various embodiments, communications of far field signals are supported. Some embodiments employ 2.4 GHz communications. In various embodiments the wireless communications can include standard or nonstandard communications. Some examples of standard wireless communications include, but are not limited to, FM, AM, SSB, BLUETOOTH™, IEEE 802.11 (wireless LANs) wi-fi, 802.15 (WPANs), 802.16 (WiMAX), 802.20, and cellular protocols including, but not limited to CDMA and GSM, ZigBee, and ultra-wideband (UWB) technologies. Such protocols support radio frequency communications and some support infrared communications. It is possible that other forms of wireless communications can be used such as ultrasonic, optical, and others. It is understood that the standards which can be used include past and present standards. It is also contemplated that future versions of these standards and new future standards may be employed without departing from the scope of the present subject matter.

Such wireless devices 102 include, but are not limited to, cellular telephones, personal digital assistants, personal computers, streaming audio devices, wide area network devices, local area network devices, personal area network devices, and remote microphones. In various embodiments, the wireless device 102 includes one or more of the interface embodiments demonstrated in U.S. Provisional Patent Application Ser. No. 60/687,707, filed Jun. 5, 2005, entitled: COMMUNICATION SYSTEM FOR WIRELESS AUDIO DEVICES, and U.S. patent application Ser. No. 11/447,617, filed Jun. 5, 2006, entitled: COMMUNICATION SYSTEM FOR WIRELESS AUDIO DEVICES which claims the benefit of the provisional application, the entire disclosures of which are hereby incorporated by reference. This is also applicable to wireless devices 202, 302, and 402 as described herein.

In the embodiment demonstrated by FIG. 1A, the listener has primary and secondary wireless hearing assistance devices R1 and R2. The wireless hearing assistance devices include, but are not limited to, various embodiments of hearing aids. In one embodiment, at least one wireless hearing assistance device is a behind-the-ear hearing aid. In one embodiment, at least one wireless hearing assistance device is an in-the-ear hearing aid. In one embodiment, at least one wireless hearing assistance device is a completely-in-the-canal hearing aid. In one embodiment, at least one wireless hearing assistance device is a wireless earpiece. In one embodiment, at least one wireless hearing assistance device is a behind-the-ear hearing aid with a wireless adaptor attached. Various examples of wireless adapters for some hearing assistance devices using a direct-audio input (DAI) interface are demonstrated in U.S. patent application Ser. No. 11/207,591, filed Aug. 18, 2005, entitled "WIRELESS COMMUNICATIONS ADAPTER FOR A HEARING ASSISTANCE DEVICE;" and PCT Patent Application No. PCT/US2005/029971, filed Aug. 18, 2005, entitled "WIRELESS COMMUNICATIONS ADAPTER FOR A HEARING ASSISTANCE DEVICE," the entire disclosures of which are incorporated by reference.

In the system of FIG. 1A, the communication protocol of wireless device 102 is adapted to controllably provide wireless communications 105, 109 to both the primary wireless hearing assistance device R1 and the secondary wireless hearing assistance device R2. In various embodiments, the communications are unidirectional. In various embodiments, the communications are bidirectional. In various embodiments, the communications include at least one unidirectional communication and one bidirectional communication. Thus, the system is highly programmable to adapt to a number of communication requirements and applications. The system is adapted to provide binaural information to both R1 and R2 based a monaural signal from wireless device 102.

In embodiments using BLUETOOTH as the communication protocol, it is noted that BLUETOOTH is normally directed for point-to-point communications using PINs (personal identification numbers), such that the wireless device 102 is typically paired with only one other device, such as primary device R1. Thus, to allow the wireless device 102 to also communicate with secondary device R2, a second pairing must be done, whether by standard or nonstandard means.

Figure 1B:
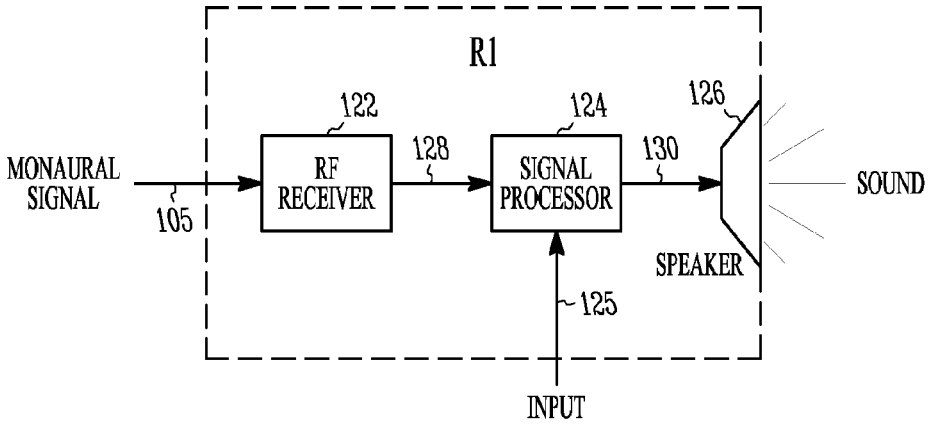
FIG. 1B shows a block diagram of signal flow in a hearing assistance device according to one embodiment of the present subject matter.

FIG. 1B shows a block diagram of signal flow in a hearing assistance device according to one embodiment of the present subject matter. For purposes of demonstration, this block diagram will be that of wireless audio device R1. However, it is understood that R2 or any other wireless audio device receiving the monaural signal from wireless device 102 could employ the subject matter of FIG. 1B without departing from the scope of the present subject matter.

The monaural signal 105 is received by receiver 122 which demodulates the signal and provides the audio signal 128 to signal processor 124. Signal processor 124 processes the signal to provide signal 130, which is then sent to speaker 126 to play the processed signal 130 to one ear of a wearer of R1. Various inputs from a user or from other external programming means may be employed to provide control to the signal processing performed by signal processor 124. These inputs can be accomplished with a variety of switches, and or programming ports, as needed to provide signal processing selections and/or parameters for the system.

In one embodiment, signal processor 124 is a digital signal processor. In one embodiment, signal processor 124 comprises hardware and software to accomplish the signal processing task. In one embodiment, signal processor 124 employs dedicated hardware in combination with other computational or digital signal processing hardware to perform the signal processing task. It is understood that a separate amplifier may be used for amplifying the signal 130 before sending it to speaker 126 as is known in the art. Thus, FIG. 1B is intended to demonstrate the basic operational blocks at one level and is not intended to be exclusive or exhaustive of the expressions of the present subject matter.

Figure 1C:
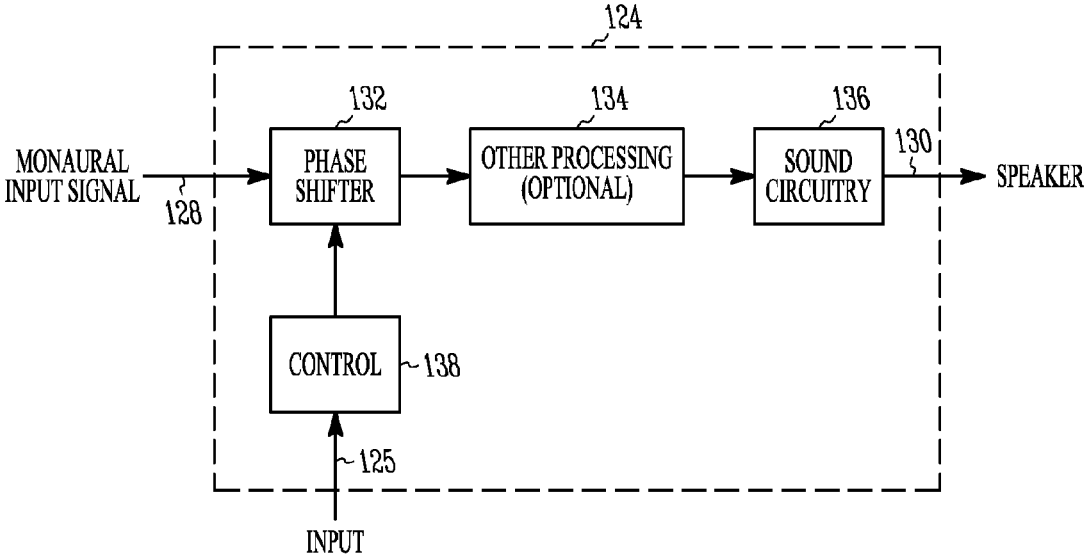
FIG. 1C shows detail of the signal processing block of FIG. 1B according to one embodiment of the present subject matter.

FIG. 1C shows detail of the signal processing block 124 of FIG. 1B according to one embodiment of the present subject matter. In this example, the monaural input signal 128 is processed by phase shifter 132 to provide a phase shifted version of the input signal 128. In various embodiments, the phase shift arises from a constant time delay applied to input signal 128. In various embodiments, the phase shift arises from a constant phase shift at all frequencies applied to input signal 128. In various embodiments, the phase shift arises from a phase shift that is varying as a function of frequency. Thus, control 138 provides some form of setting for adjusting phase shift and/or for selecting the type of phase shift to be applied. In one embodiment, the signal 125 is provided by a source external to the hearing assistance device R1 to control the phase shift. Various means for supplying signal 125 include one or more of switches operable by the user, soft switches programmed by a programming device attached to the hearing assistance device, or any combination of such inputs. Furthermore, in various embodiments, signal 125 may be internally generated by systems within the programming device to provide phase shift control as a function of one or more of sound received, conditions detected, and other processes requiring a change of either phase shift amount and/or mode. The signal 125 may also be transmitted and received by the device to adjust its operation.

For example, signal 125 could be generated as a result of a telephone device in proximity to the hearing assistance device to lateralize received sounds to the ear proximal the telephone. As another example, signal 125 can be generated to discontinue phase adjustment when the user receives a wireless signal indicating a ringing telephone. As another example, signal 125 can be generated to discontinue phase adjustment when detecting an emergency vehicle or other siren in proximity. Many other applications and operations of the system are possible without departing from the scope of the present subject matter. Those provided herein are intended to be demonstrative and not exhaustive or limiting of the present subject matter.

FIG. 1C also shows the phase shifted signal may optionally be processed for other effects by processor 134. The resulting signal is sent to amplifier circuit 136 to generate output 130 for speaker 126. Processor 134 allows further adjustment of the signal, including level adjustment. For example, the level and phase of the signal 130 can be programmably controlled, in one embodiment. If the hearing assistance device on the other ear (e.g., R2) does not adjust phase or level, then by controlling R1 a wearer of the hearing assistance devices R1 and R2 can experience both interaural level differences and interaural time/phase differences that are adjustable and controllable.

In applications where both R1 and R2 include the system of FIGS. 1A-1C, the settings of both devices can be adjusted to achieve desired interaural level and interaural time/phase differences. One way of communicating settings to both devices is to use signals embedded in the monaural information signals S1 that are received by R1 and R2. Thus, the monaural information is identical in such embodiments, but the signals provided may be used to adjust R1 relative to R2. Such embodiments require processing on wireless device 102 to provide appropriate control of R1 with respect to R2. It is understood that in one embodiment, such systems may employ a signaling that adjusts only R1, leaving R2 to operate without adjustment. In one embodiment, both R1 and R2 receive signals that adjust both devices to relatively provide the desired interaural level and/or interaural time/phase differences. In other embodiments, the signals for such interaural differences are generated within R1 and/or R2. For example, in a telephone sensing embodiment, the electronics of R1 may include a magnetic field sensor which programs R1 to shift to a telecoil mode (thereby turning off or diminishing the local microphone-received sound of the hearing assistance device R1) when a telephone is detected at or near R1. Many other embodiments and applications are possible without departing from the scope of the present subject matter.

Figure 2:
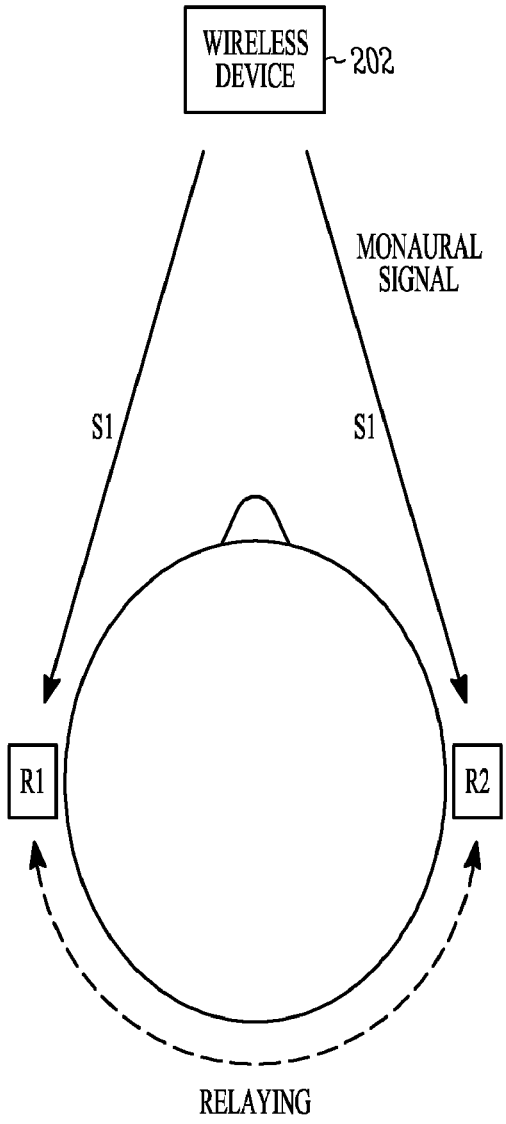
FIG. 2 shows one system of devices in a relaying communication mode according to one embodiment of the present subject matter.

Other signaling and communications modes may be accomplished without departing from the scope of the present subject matter. For example, FIG. 2 shows one system of devices in a relaying communication mode according to one embodiment of the present subject matter. The relaying can be of control signals, audio signals, or a combination of both. The relaying can be accomplished to perform functions adjusting phase and amplitude of both R1 and R2 and provides the ability to control lateralization and volume of the monaural signal to both ears. For example, when one ear detects a telephone signal, the relayed signal could include instructions to shut off or diminish the local received sound to the other ear to better hear the caller. The relayed signal could also lateralize the sound to the device detecting the phone to enjoy the enhanced benefits of binaural reception of the caller. Such embodiments can provide relaying of the caller's voice to the ear without the telephone against it, albeit at the proper phase and level to properly lateralize the sound of the caller's voice.

New virtual communication modes are also possible. When used in conjunction with telecommunications equipment, the system could provide a virtual handheld phone function without the user ever picking up the phone. For example, with this system, the user may answer his/her telephone (signaled from a ringing telephone), engage in a wireless session with his/her phone (e.g., Bluetooth communications with a cellular phone), and the system will programmably and automatically lateralize sound to a desired ear for binaural reception of the caller. All these activities can be performed without ever having to pick the phone up or place it near the ear. Those of skill in the art will readily appreciate a number of other applications within the scope of the present subject matter.

In some embodiments, it is possible to also insert special audio information for playing to one or more ears based on events. For example, given the previous example of virtual phone, a voice could play when caller identification identifies the caller to let the wearer know who the caller is and to decide whether to answer his/her phone.

Other applications too numerous to mention herein are possible without departing from the scope of the present subject matter.

Figure 3:
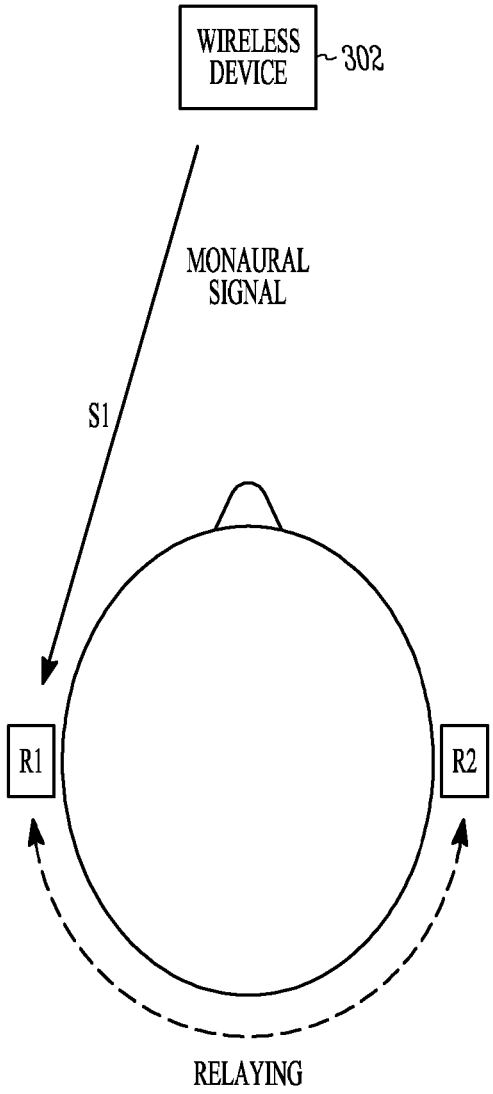
FIG. 3 shows one system of devices in a relaying communication mode according to one embodiment of the present subject matter.

FIG. 3 shows one system of devices in a relaying communication mode according to one embodiment of the present subject matter. In the embodiment of FIG. 3 it is possible to allow one receiver (e.g., R1) to be used to receive the monaural signal S1 and thereby relay the audio and/or control information to a second receiver (R2) in a relaying mode. The information communicated from wireless device 302 to primary device R1 is retransmitted to secondary device R2. Such systems have an additional time delay for the relay signal to reach secondary device R2 with the information. Thus, for synchronization of the information timing, the system may employ delay in the primary device R1 to account for the extra time to relay the information to secondary device R2.

This additional relaying option demonstrates the flexibility of the system. Other relaying modes are possible without departing from the scope of the present subject matter.

In the various relaying modes provided herein, relaying may be performed in a variety of different embodiments. In one embodiment, the relaying is unidirectional. In one embodiment the relaying is bidirectional. In one embodiment, relaying of audio information is unidirectional and control information is bidirectional. Other embodiments of programmable relaying are possible involving combinations of unidirectional and bidirectional relaying. Thus, the system is highly programmable to adapt to a number of communication requirements and applications.

Figure 4A:
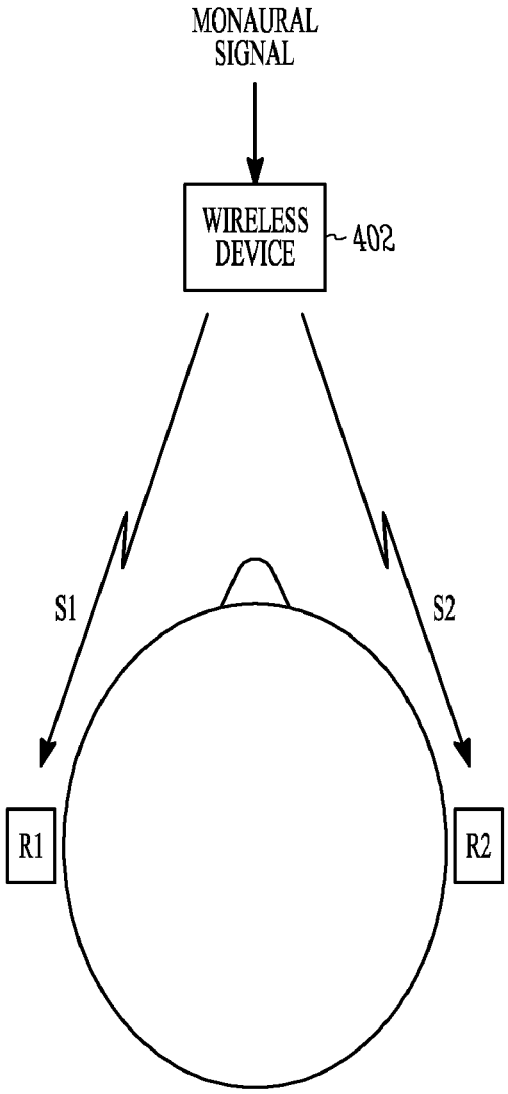
FIG. 4A shows one system providing multiple signals according to one embodiment of the present subject matter.

FIG. 4A shows one system providing multiple signals according to one embodiment of the present subject matter. This system demonstrates that phase and/or level adjustment may be performed at the wireless device 402 to provide a first signal S1 and a second signal S2 from a single monaural signal. In some embodiments, the signals S1 and S2 are adjusted to the desired interaural phase/time delay and interaural level differences by wireless device 402 and then played to the wearer of R1 and R2 without further adjustments to the phase and/or level. In some embodiments, further adjustment of the interaural phase/time delay and/or interaural level can be performed by either R1 or R1 or both in combination. The adjustments to interaural phase/time delay and/or interaural level are controllable by inputs to the wireless device 402 and many of the same applications can be performed as set forth herein.

Figure 4B:
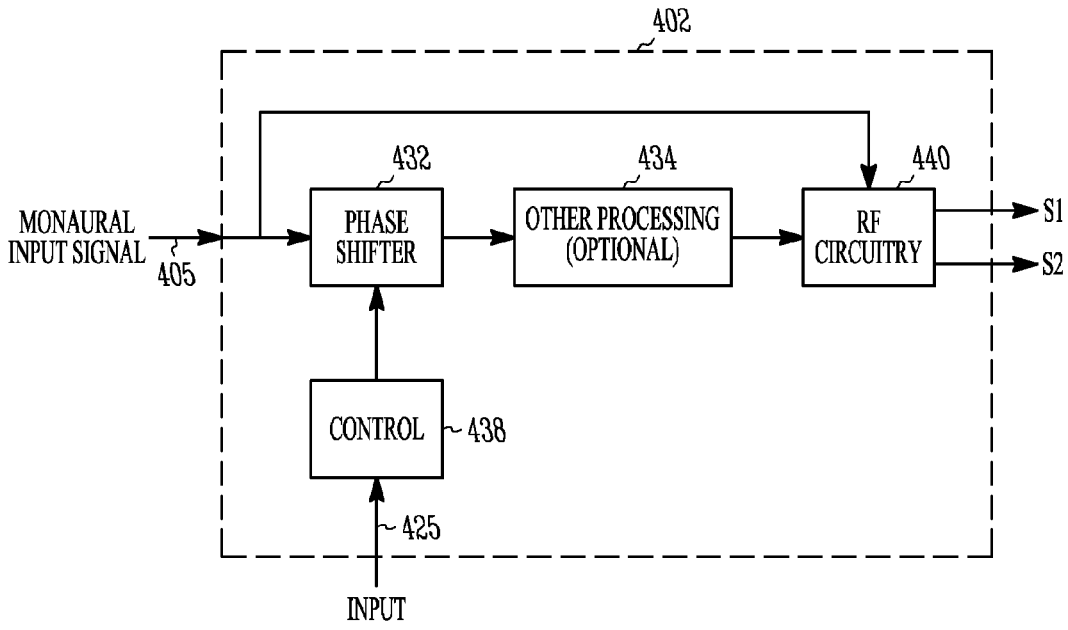
FIG. 4B shows a signal flow of a wireless audio controller according to one embodiment of the present subject matter.

FIG. 4B shows a signal flow of a wireless audio controller according to one embodiment of the present subject matter. In this example, the monaural input signal 405 is processed by phase shifter 432 to provide a phase shifted version of the input signal 405. In various embodiments, the phase shift arises from a constant time delay applied to input signal 405. In various embodiments, the phase shift arises from a constant phase shift at all frequencies applied to input signal 405. In various embodiments, the phase shift arises from a phase shift that is varying as a function of frequency. Thus, control 438 provides some form of setting for adjusting phase shift and/or for selecting the type of phase shift to be applied. In one embodiment, the signal 425 is provided by a source external to the hearing assistance device R1 to control the phase shift. Various means for supplying signal 425 include one or more of switches operable by a user, soft switches programmed by a programming device, or any combination of such inputs. Furthermore, in various embodiments, signal 425 may be internally generated by systems within the programming device to provide phase shift control as a function of one or more of sound received, conditions detected, and other processes requiring a change of either phase shift amount and/or mode. The signal 425 may also be transmitted and received by the device to adjust its operation.

The phase adjusted signal may also be further processed using processor 434. The resulting signal is sent to radio transmitter 440 to provide S1 and S2 with the desired interaural phase/time delay and interaural level adjustments. Thus, the phase shifter circuitry is located at the wireless device 402 in this embodiment. In various embodiments, the wireless device 402 includes one or more of the interface embodiments demonstrated in U.S. Provisional Patent Application Ser. No. 60/687,707, filed Jun. 5, 2005, entitled: COMMUNICATION SYSTEM FOR WIRELESS AUDIO DEVICES, and U.S. patent application Ser. No. 11/447,617, filed Jun. 5, 2006, entitled: COMMUNICATION SYSTEM FOR WIRELESS AUDIO DEVICES which claims the benefit of U.S. Provisional Application Ser. No. 60/687,707, the entire disclosures of which are hereby incorporated by reference. The functionalities of the wireless audio controller can be combined with the phase/time delay and level adjusting features described herein. Various different inputs may be used in combination to perform phase/time delay adjustment control and interaural level adjustment control.

The system of FIG. 4 can perform many of the applications set forth above for those systems of FIGS. 1-3. Furthermore, the systems may work in conjunction to provide interaural phase/time delay and interaural level adjustment of the signals for a variety of applications. Various different inputs may be used in combination to perform phase/time delay adjustment control and interaural level adjustment control.

The following discussion applies to all of the embodiments set forth herein. For audio applications including speech, a number of modes exist for binaural presentation of speech to the primary device and secondary device. Binaural speech information can greatly enhance intelligibility of speech. This is especially so when speech has been distorted through a vocoder and when the wearer is attempting to listen in a noisy environment. The following modes also provide other advantages to speech information, such as loudness summation and a release of masking making the speech more understandable in a noisy environment.

1) Coherent Signals: When signals are coherent, the signals provided to a wearer of, for example, a hearing aid receiving signals via the DAI interfaces are identical, producing a perception of centered sound to the user. Such speech would be diotic.

2) Incoherent Signals: A phase shift is applied across the spectrum of the signal either in the primary or the secondary device. For example, the speech signal in the secondary device could be inverted, equivalent to providing a 180 degree phase shift at all frequencies. The binaural speech will be perceived as diffuse and may be preferred by the wearer over the centered, diotic speech associated with coherent signals (above). The speech in the case of incoherent signals is dichotic. Those of skill in the art will know that many phase adjustments can be made to achieve a diffuse perception, including a constant change across frequency of a phase value other than 180 degrees, and a frequency-varying phase change. Time-domain filters, such as all-pass filters, can also be used to adjust the phase of the signal without the use of time-to-frequency conversion. One approach to providing such a phase shift includes conversion of the time domain signals processed by the system into frequency domain signals and then application of a predetermined phase to create the 180 degree shift for all frequencies of interest.

3) Lateralized Signals: A delay and/or attenuation is applied to the speech in either the primary or secondary device in order for the speech to be perceived as coming from the side that did not receive the delay and/or attenuation. Typical numbers include, but are not limited to, a one millisecond delay and a one decibel attenuation. Typical ranges of delay include, but are not limited to, 0.3 milliseconds to 10 milliseconds. One such other range includes 0.2 milliseconds to 5 milliseconds. Typical attenuation ranges include, but are not limited to, 1 decibel and 6 decibels. One such other range includes 1 decibel to 10 decibels. Other delays and attenuations may be used without departing from the scope of the present subject matter. A listener may prefer, for example, a one millisecond delay and a one decibel attenuation, since speech from, for example, a cell phone, is normally heard in one ear and since the perceived sound will be in one ear, yet retain the benefits of having a binaural signal to the listener. In various embodiments, the attenuations and delays are programmed by the dispensing professional using hearing aid fitting software. So, different patients could have different parameters set according to their preference. Some patients may prefer diffuse sound, some may prefer sound to their left, some may prefer sound to their right, etc.

The wearer's voice in various embodiments can be transmitted back to the wireless device. For example, in cases where the wireless device is a cell phone and the primary and secondary wireless hearing assistance devices are hearing aids, it is understood that the communications back to the cell phone by the aids include:

1) In one embodiment, the primary device (e.g., hearing aid) paired with the wireless device (e.g., cell phone) transmits the wearer's voice back to the wireless device (cell phone) and does not transmit this to the secondary device (e.g., other hearing aid). Thus, no voice pickup is used by the secondary device and no transmission of the wearer's voice is made from secondary device to primary device.

2) In one embodiment, the secondary device (e.g., other hearing aid) does transmit audio to the primary device (e.g., hearing aid paired with the cell phone).

In varying embodiments, the signals picked up from the primary device and secondary device can be processed in a variety of ways. One such way is to create a beamformed signal that improves overall signal-to-noise ratio that is transmitted back to the wireless device (e.g., cell phone). A delay would be added to the primary voice-pickup signal before effective combination with the secondary voice signal. Such a system can steer the beam to a location orthogonal to the axis formed by a line connecting primary and secondary, i.e., the direction of maximum sensitivity of the beamformed signal can be set at the location of the wearer's mouth. In addition to beam forming, noise cancellation of uncorrelated noise sources can be accomplished. In one application, such cancellation can take place by the primary device prior to transmission to the wireless device. These techniques improve the signal-to-noise ratio and quality of the signal received by a person listening to the signals from the wireless device (e.g., a person at the other end of the communication, for example, at another telephone).

It is understood that the present phase shifter could be replaced with a processor offering a head-related transfer function (HRTF) which performs phase and level changes as a function of frequency that are specific to the acoustic transfer function from a free field source to the ear of the listener. Such processing could be accomplished using a digital signal processor or other dedicated processor.

It is understood that the examples set forth herein can be applied to a variety of wireless devices and primary and secondary device combinations. Thus, the examples set forth herein are not limited to telephone applications. It is further understood that the wireless devices set forth herein can be applied to right and left hearing applications as desired by the user and is not limited to any one direction of operation.

This description has set forth numerous characteristics and advantages of various embodiments and details of structure and function of various embodiments, but is intended to be illustrative and not intended in an exclusive or exhaustive sense. Changes in detail, material and management of parts, order of process and design may occur without departing from the scope of the appended claims and their legal equivalents.

What is claimed is:

1. An apparatus for a user having a first ear and a second ear, comprising:

a wireless device to transmit a radio signal containing monaural information;

a first hearing assistance device including: a first radio receiver to receive the radio signal; an adjustable phase shifter adapted to apply a plurality of controllable, incremental phase shifts to the monaural information on the radio signal; and a first speaker to produce a first audio signal for the first ear; and a second hearing assistance device including a second radio receiver and a second speaker to produce a second audio signal for the second ear, wherein the first and second audio signals are produced with adjustable relative phase based on a setting of the adjustable phase shifter.

2. The apparatus of claim 1, wherein the first hearing assistance device includes a first adjustable level control.

3. The apparatus of claim 2, wherein the second hearing assistance device includes a second adjustable level control.

4. The apparatus of claim 1, wherein the second hearing assistance device includes an adjustable level control.

5. The apparatus of claim 1, wherein the first hearing assistance device includes a microphone.

6. The apparatus of claim 5, wherein the second hearing assistance device includes a microphone.

7. The apparatus of claim 1, wherein the second hearing assistance device includes a microphone.

8. The apparatus of claim 1, wherein the wireless device is a cellular phone.

9. The apparatus of claim 1, wherein the wireless device is a wireless audio controller (WAC) providing packetized audio to the first and second hearing assistance devices.

10. The apparatus of claim 1, further comprising a manual adjuster for setting the adjustable phase shifter.

11. The apparatus of claim 1, further comprising an automatic adjuster for automatic adjustment of the adjustable phase shifter.

12. The apparatus of claim 1, wherein the second hearing assistance device includes a receiver to receive signals from the wireless device.

13. The apparatus of claim 12, wherein the second hearing assistance device includes a receiver to receive signals from the first hearing assistance device.

14. The apparatus of claim 1, wherein the second hearing assistance device includes a receiver to receive signals from the first hearing assistance device.

15. The apparatus of claim 1, wherein the first hearing assistance device includes a magnetic field sensor.

16. The apparatus of claim 1, wherein the first hearing assistance device includes a processor for generating a head-related transfer function and for controlling the phase shifter based on the head-related transfer function.

17. A system for a user having a first ear and a second ear, comprising:

a wireless device comprising: a controllable phase shifter adapted to receive a monaural information signal and convert it into a first monaural signal and a second monaural signal, the first and second monaural signals having an interaural phase shift; and a radio transmitter to transmit the first monaural signal and the second monaural signal;

a first hearing assistance device including: a first radio receiver adapted to receive the first monaural signal; and a first speaker to produce a first audio signal for the first ear; and a second hearing assistance device including: a second radio receiver adapted to receive the second monaural signal; and a second speaker to produce a second audio signal for the second ear.

18. The apparatus of claim 17, wherein the first hearing assistance device includes a first interaural level adjustment control.

19. The apparatus of claim 18, wherein the second hearing assistance device includes a second interaural level adjustment control.

20. The apparatus of claim 17, wherein the second hearing assistance device includes an interaural level adjustment control.

21. The apparatus of claim 17, wherein the first hearing assistance device includes a microphone.

22. The apparatus of claim 21, wherein the second hearing assistance device includes a microphone.

23. The apparatus of claim 17, wherein the second hearing assistance device includes a microphone.

24. The apparatus of claim 17, wherein the wireless device is a cellular phone.

25. The apparatus of claim 17, wherein the wireless device is a wireless audio controller (WAC) providing packetized audio to the first and second hearing assistance devices.

26. The apparatus of claim 17, further comprising a manual adjuster for setting the adjustable phase shifter.

27. The apparatus of claim 17, further comprising an automatic adjuster for automatic adjustment of the adjustable phase shifter.

28. The apparatus of claim 25, wherein the second hearing assistance device includes a receiver to receive signals from the first hearing assistance device.

29. The apparatus of claim 27, wherein the second hearing assistance device includes a receiver to receive signals from the first hearing assistance device.

30. The apparatus of claim 17, wherein the second hearing assistance device includes a receiver to receive signals from the first hearing assistance device.

31. The apparatus of claim 17, wherein the first hearing assistance device includes a magnetic field sensor.

32. The apparatus of claim 17, wherein the first hearing assistance device includes a processor for generating a head-related transfer function and for controlling the phase shifter based on the head-related transfer function.

33. A method for providing sound to a first ear and a second ear of a wearer of first and second hearing assistance devices, comprising:

receiving a monaural information signal from a radio transmitter external to the first hearing assistance device and the second hearing assistance device, the receiving using at least a first radio receiver of the first hearing assistance device;

converting the monaural information signal into a first monaural signal and a second monaural signal, the first and second monaural signals differing in relative phase which is controllable; and providing a first sound based on the first monaural signal to the first ear of the wearer and a second sound based on the second monaural signal to the second ear of the wearer to provide binaural sound to the wearer.

34. The method of claim 33, further comprising adjusting relative phase to lateralize the binaural sound perceived by the wearer.

35. The method of claim 33, further comprising adjusting a level of the first sound.

36. The method of claim 35, further comprising adjusting a level of the second sound.

37. The method of claim 33, further comprising entering a telecoil mode when a telephone is in proximity to the first hearing assistance device.

38. The method of claim 37, further comprising reducing level of the second sound when a telephone is in proximity to the first hearing assistance device.

39. The method of claim 33, further comprising generating interaural delay and interaural level differences based on a head-related transfer function.

40. The method of claim 33, further comprising relaying audio information from the first hearing assistance device to the second hearing assistance device.

41. The method of claim 33, further comprising relaying control information from the first hearing assistance device to the second hearing assistance device.

42. The method of claim 33, further comprising relaying audio and control information from the first hearing assistance device to the second hearing assistance device.

43. The method of claim 33, further comprising providing a constant time delay between the first monaural signal and the second monaural signal.

44. The method of claim 33, further comprising providing a constant phase delay between the first monaural signal and the second monaural signal.

45. The method of claim 33, further comprising providing a varying phase delay between the first monaural signal and the second monaural signal.

* * * * *